US008640904B2

(12) United States Patent
Steininger et al.

(10) Patent No.: US 8,640,904 B2
(45) Date of Patent: Feb. 4, 2014

(54) FLOW CONTROL VALVE FOR DISPENSING A SOURCE OF FLUID

(75) Inventors: Jeff Steininger, St. Mary's, OH (US); Nick Malara, Spokane, WA (US)

(73) Assignee: Zak Designs, Inc., Spokane, WA (US)

( * ) Notice: Subject to any disclaimer, the term of this patent is extended or adjusted under 35 U.S.C. 154(b) by 58 days.

(21) Appl. No.: 13/402,676

(22) Filed: Feb. 22, 2012

(65) Prior Publication Data

US 2013/0213966 A1 Aug. 22, 2013

(51) Int. Cl.
*A47G 19/22* (2006.01)
*B65D 51/18* (2006.01)

(52) U.S. Cl.
USPC ..... 220/254.4; 220/253; 220/714; 220/719

(58) Field of Classification Search
USPC ..... 220/254.4, 253, 714, 719
See application file for complete search history.

(56) References Cited

U.S. PATENT DOCUMENTS

| | | | | |
|---|---|---|---|---|
| 3,860,111 | A * | 1/1975 | Thompson | 206/534 |
| 6,626,314 | B1 * | 9/2003 | McHenry et al. | 220/254.2 |
| 7,090,098 | B2 * | 8/2006 | Livingston et al. | 222/651 |
| 7,823,740 | B2 * | 11/2010 | Perra | 220/254.4 |
| 8,261,951 | B2 * | 9/2012 | Webster et al. | 222/370 |
| 8,328,044 | B1 * | 12/2012 | Iskandar | 220/713 |
| 2013/0062347 | A1 * | 3/2013 | Webster et al. | 220/253 |

* cited by examiner

*Primary Examiner* — Mickey Yu
*Assistant Examiner* — Niki Eloshway
(74) *Attorney, Agent, or Firm* — Paine Hamblen, LLP

(57) ABSTRACT

A flow control valve is described and which includes a first portion, and a second portion, and wherein the first portion rotates relative to the second portion and wherein the invention further includes a rigid locking member which cooperates with a resilient sealing and biasing member which is carried to positions which, on the one hand, either seals the vessel to prevent the escape of fluid from the vessel, or which allows the convenient dispensing of fluid from the vessel.

9 Claims, 8 Drawing Sheets

FLOW CONTROL VALVE FOR DISPENSING A SOURCE OF FLUID

TECHNICAL FIELD

The present invention relates to a flow control valve for dispensing a source of fluid, and more specifically to a novel arrangement for sealing and unsealing a drinking vessel, and which further prohibits the inadvertent dispensing of fluid contained within the drinking vessel in the event that the drinking vessel is accidently overturned.

BACKGROUND OF THE INVENTION

Drinking containers or vessels of various types including travel mugs are well known in the art. Such drinking vessels have been designed for various purposes such as to be used on bicycles, while hiking, and doing various indoor and outdoor activities.

In this art field, much effort has been undertaken to design various removable lids, closure devices or other mechanisms for opening and closing a drinking or fluid dispensing orifice so as to allow the convenient dispensing of the source of fluid contained within the drinking vessel, and further, to prohibit the spilling of the fluid contained within the drinking vessel should it be accidentally overturned.

Assorted different commercially available products are available which provide various drinking spouts or tops which may be opened for drinking, or closed and placed in a sealed orientation, and which will allow the user to drink from the vessel under various operational conditions.

While the aforementioned prior art devices have operated with varying degrees of success, there are perceived shortcomings with their individual designs which have detracted from the commercial usefulness. For example, in some of the prior art drinking vessels utilized heretofore, such drinking vessels have not sealed reliably and therefore leak when the drinking vessel is accidentally overturned, such as might be occasioned when the drinking vessel is being used in an automobile or being carried in a backpack, or similar personally carried luggage. While attempts have been made to correct the readily apparent shortcomings in these designs, the resulting products have experienced still other problems. Chief among these additional problems is that these previous attempts to produce fluid impervious drinking lids or covers have usually resulted in the manufacture of products having rather complex designs. While these improved lids, or covers, have operated with some degree of success, the complex designs of these resulting covers have made them burdensome and costly to manufacture. Further, these rather complex designs have proven to be either difficult, or impossible to effectively clean. Consequently, after prolonged use, or after the drinking vessel has been used for a period of time with a drink which contains sugar, or the like, such operating parts of these drinking vessel lids or covers become sticky and then begin to malfunction. Still further, the sticky residue resulting from the fluid which is deposited on such operating parts of these prior art drinking lids create an unsanitary condition which eventually renders the drinking vessel lid or top unserviceable.

Therefore, a flow control valve for dispensing a source of fluid from a vessel which avoids the detriments individually associated with the prior art devices, and which provides a convenient means by which a user may easily open and close a vessel containing a fluid to be dispensed, and which additionally can be easily disassembled for cleaning, and the like, is the subject matter of the present invention.

SUMMARY OF THE INVENTION

A first aspect of the present invention relates to fluid dispensing vessel which includes a flow control valve for dispensing a source of fluid, and which includes a source of a fluid to be dispensed, and which is enclosed within a vessel; a first portion of the flow control valve which releasably, matingly cooperates with the vessel, and which further defines a first aperture through which the source of fluid may pass therethrough, and a second aperture; a rotatable control member which rotatably cooperates with the first portion, and which has a main body which defines a fluid dispensing aperture, which, when substantially coaxially aligned with the first aperture, allows the source of fluid to pass out of the vessel, and wherein, when the fluid dispensing aperture is not substantially coaxially aligned with the first aperture, the rotatable control member occludes the first aperture, and wherein the rotatable control member further has a post which is dimensioned so as to be received within the second aperture is defined by the first portion, and wherein the rotatable control member rotates about the post and relative to the first portion; and a second portion of the flow control valve which is releasably mounted on, and which co-rotates with the post, and wherein the first portion of the flow control valve is positioned therebetween the rotatable control member and the second portion, and wherein the second portion substantially occludes the first aperture, which is defined by the first portion, when the fluid dispensing aperture is not substantially coaxially aligned with the first aperture.

Still another aspect of the present invention relates to a fluid dispensing lid which includes a source of fluid to be dispensed, and which is enclosed within a vessel having a neck; a first portion of a flow control valve having a main body with a first end which releasably mates with the neck of the vessel, and an opposite second end, and wherein the main body further defines a lower, first cavity, and an upper, or second cavity, and wherein the first and second cavities are separated, one from the other by a separation surface, and wherein a first, second and third aperture are formed in the separation surface, and wherein the first aperture permits the source of fluid to pass therethrough, and wherein the third aperture permits ambient air to pass into the vessel when the source of fluid is poured from the vessel through the first aperture; a rotatable control member having a main body with a top and bottom surface, and further having a peripheral edge, and wherein a fluid dispensing aperture is defined by the main body, and wherein a post extends downwardly from the bottom surface, and is sized so as to be received in, and extend through, the second aperture which is defined by the first portion of the flow control valve, and wherein the main body of the rotatable control member further defines a bottom cavity which matingly receives, at least in part, a portion of the first end of the first portion of the flow control valve, and wherein the bottom surface of the rotatable control member is received, at least in part, within the upper or second cavity of the first portion of the flow control valve, and wherein the rotatable control member coaxially rotates relative to the first portion of the flow control valve, and wherein the source of fluid can flow from the vessel when the fluid dispensing aperture is substantially coaxially aligned with the first aperture which is defined by the first portion of the flow control valve; a rigid locking member which releasably mates and substantially co-rotates with the post, and wherein the first portion of the flow control valve is located therebetween the rigid locking member, and the main body of the rotatable control member, and wherein the rigid locking member defines first second and third passageways extending therethrough; and a resilient sealing and biasing member matingly coupled with, and juxtaposed relative to the rigid locking member, and located therebetween the first portion of the flow control valve, and the rigid locking member, and wherein the resilient sealing and biasing member co-rotates with the rigid locking member, and further exerts a biasing force against the rigid locking member and the separation surface of the first portion of the flow control valve so as to resiliently urge the first portion of the flow control valve, and the rotatable control member together, and wherein the resilient sealing and biasing member further defines first, and second, substantially coaxially aligned, upwardly and downwardly extending, resilient fluid blocking members which are individually operable to substantially occlude the first and third apertures and which are defined by the first portion of the fluid control valve when the rotatable control member is located in a given orientation relative to the first portion of the flow control valve.

These and other aspects of the present invention will be described in greater detail hereinafter.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent laws "to promote the progress of science and the useful arts" [Article I, Section 8].

Figure 1:
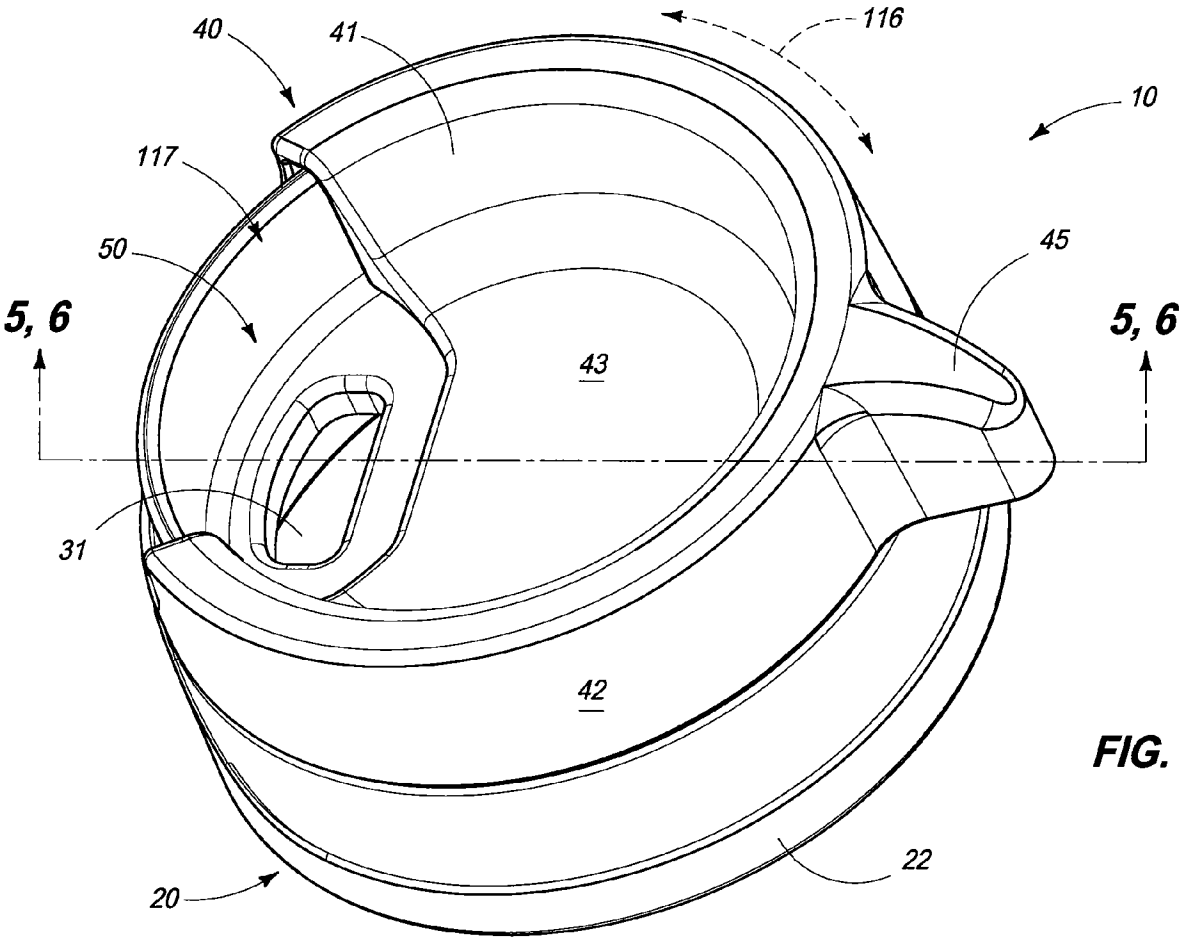
FIG. 1 is a perspective, top plan view of a flow control valve incorporating the features of the present invention, and which is shown in a first operational portion.
Figure 7:
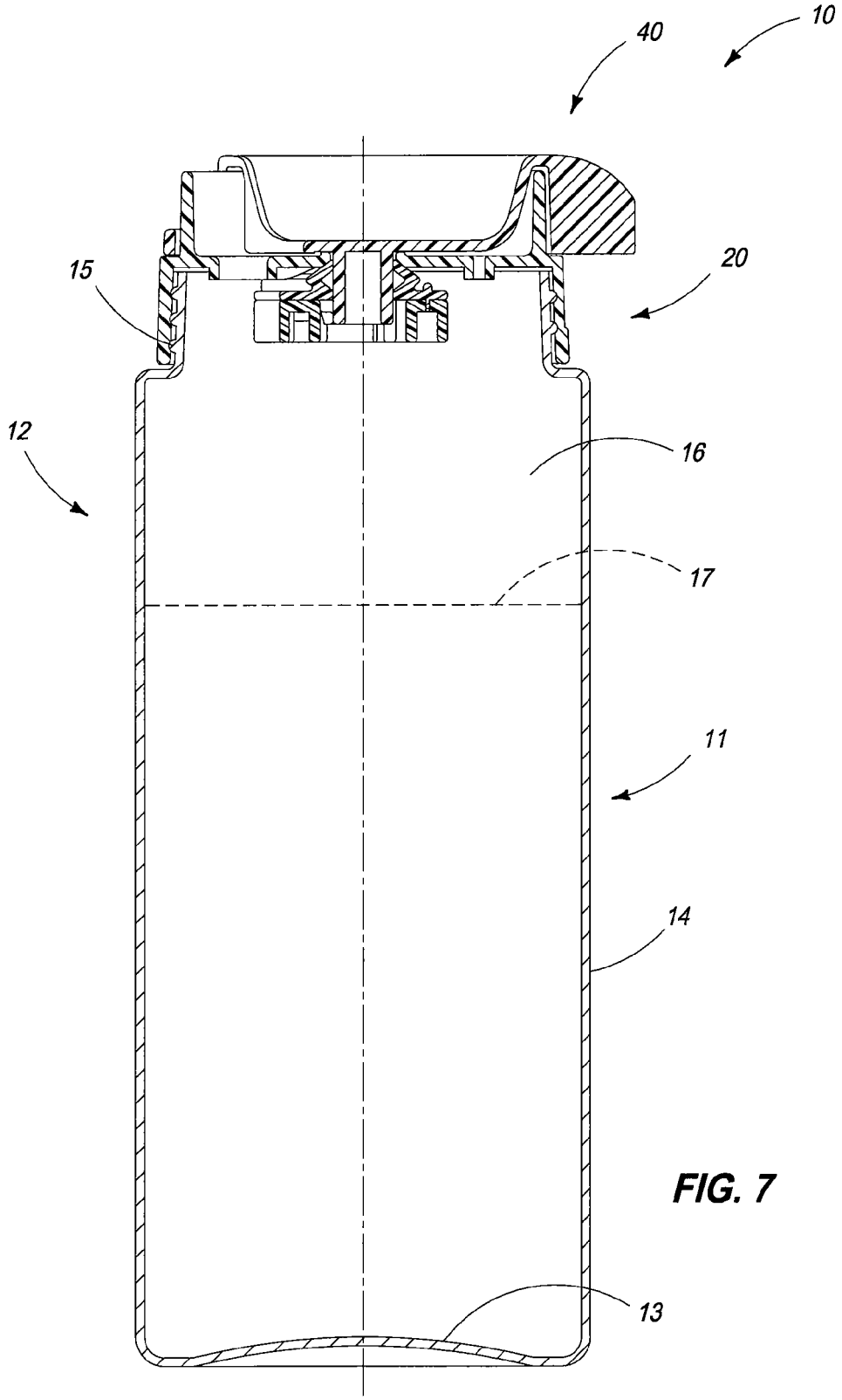
FIG. 7 is a transverse, vertical, sectional view of the present invention shown in a typical operational environment.

Present invention is generally indicated by the numeral 10 and is best understood by studying FIG. 1, and following. As best understood by a study of FIG. 7, the flow control valve 10 is shown as it would typically be employed on a vessel 11, of traditional design. The vessel 11 is defined by a main body 12 having a bottom surface 13. A continuous sidewall 14 extends generally upwardly from the bottom surface, and terminates in a reduced dimensioned neck region 15, which may be threaded, in order to facilitate the attachment of the neck 15 to a mating lid which incorporates the present invention. It will be understood that while the neck 15 is shown in a threaded configuration or arrangement, other types of attachment means may be used in the neck region 15 in order to readily, and simply, releasably affix the flow control valve 10 to the neck 15. The continuous sidewall 14 defines an internal cavity 16, and a source of fluid to be dispensed or consumed 17, is enclosed within the internal cavity 16.

Figure 4:
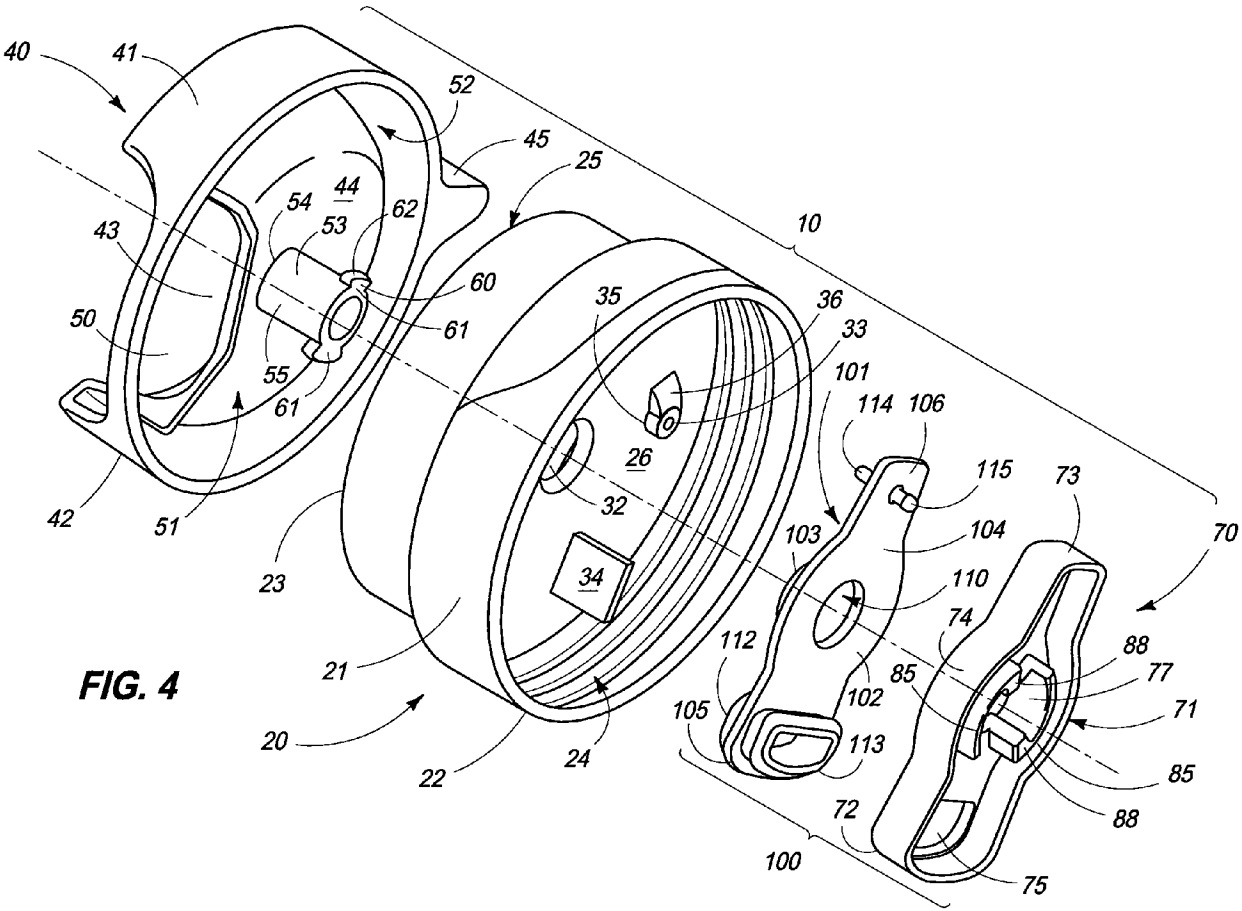
FIG. 4 is a perspective, exploded view of the flow control valve of the present invention.

As best seen in FIG. 4, and following, the flow control valve 10 of the present invention has a first portion 20 which releasably mates with the neck 15 of the vessel 11. In particular, the first portion 20 of the flow control valve has a main body 21, with a first end 22, and an opposite, second end 23. As will be appreciated from a study of FIG. 4, the first end 22 of the main body 21 has an outside diametral dimension which is greater than the outside diameter dimension of the second end 23. Still further, the main body 21 defines a lower, or first cavity 24 and an upper, second cavity 25. The first and second cavities 24 and 25 are separated, one from the other, by a separation surface 26. As best seen in the drawings, the separation surface 26 has formed therein first, second and third apertures 31, 32 and 33, respectively. It should be understood that the first aperture 31 permits the source of fluid 17 to pass therethrough, and the third aperture 33 permits ambient air to pass into the vessel 11 when the source of fluid 17 is poured from the vessel 11 through the first aperture 31. Still further, and mounted on the separation surface 26, and extending downwardly into the lower, first cavity 24 is a movement limiting member which is generally indicated by numeral 34. The movement limiting member 34 is utilized to define, at least in part, a course of travel for a rigid locking member which will be discussed in greater detail, hereinafter. Still further, and extending into the lower, or first cavity 24, of the first portion 20, is an elevated region 35 which is located on, and about, the third aperture 33. The elevated region 35 includes a ramp 36 which provides an outwardly facing surface which descends, and is then made integral with the separation surface 26. The elevated region and the associated ramp, 35 and 36, respectively, will be discussed in greater detail during the operation of the present invention. A gap, or air passaging 37 is defined between the bottom surface 44 and the first portion 20, and which extends between the third apertures 33, and the ambient environment. This passageway 37 allows ambient air to move into the cavity 16, of the vessel 11 as the fluid 17 is poured from the dispensing vessel, thereby preventing a vacuum from being created which would inhibit the smooth dispensing of the fluid 17.

As best illustrated in FIG. 1 and following, the flow control valve 10 includes a rotatable control member which is generally indicated by the numeral 40. The rotatable control member, which is coaxial rotatable relative to the first portion of the flow control valve 20 includes a main body 41 which is defined by an outside peripheral edge 42. The main body 41 further is defined by a top surface 43 and opposite bottom surface 44. As seen in FIG. 1, an operator engagement member 45 is made integral with the peripheral edge 42 and which extends generally radially outwardly thereof. As should be appreciated, an application of physical force in a given direction to the operator engagement member 45 is effective in causing the rotatable control member 40 to coaxially rotate relative to the first portion 20.

As best illustrated in FIG. 4 and following, the rotatable control member 40 has formed therein a fluid dispensing aperture 50 which is located near the peripheral edge 42, thereof, but is displaced generally radially inwardly, therefrom. Still further, the rotatable control member, and more particularly the bottom surface 44, defines a bottom cavity 51 having an annular shaped circumscribing portion 52 which circumscribes the peripheral edge 42 of the main body 41.

Figure 3:
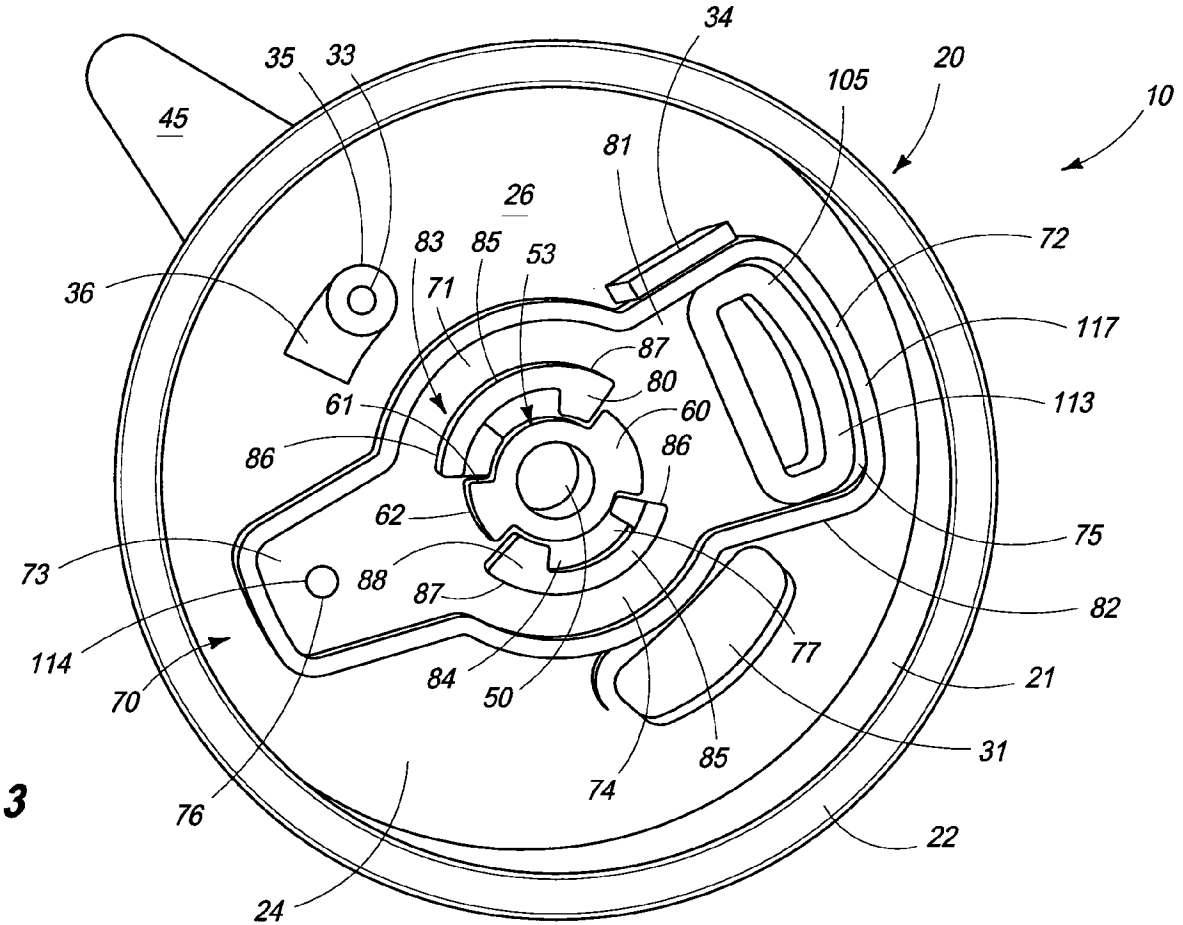
FIG. 3 is a bottom, plan view of the flow control valve of the present invention.

The bottom surface 44 is operable to be telescopingly received within the upper or second cavity 25 of the first portion 20, and further forms, at least in part, the air passageway 37. Yet further, the second end 23, of the main body 21, is operable to be received within annular portion 52, thereby allowing the rotatable control member 40 to coaxial rotate relative to the first portion 21. As further seen in FIG. 4, a substantially cylindrically shaped post 53 is mounted on, or made integral with, the bottom surface 44, and extends normally downwardly therefrom. The post 53 has a first end 54, which is made integral with the bottom surface 44, and a distal, second end 55. Extending radially outwardly relatively to the distal end are a pair of oppositely positioned locking lugs which are generally indicated by the numeral 60. Each of the respective locking lugs 60 have a first end 61, which is affixed to the distal end 55 of the post 53, and an opposite, second end 62. As best seen by reference to the bottom, plan view as seen in FIG. 3, it will be recognized that the first end 61 of the individual locking lugs 60 have a first cross-sectional dimension, and the second end 62, thereof, has a cross-sectional dimension greater than the first end. Still further, as will be recognized from a study of FIG. 3, the individual locking lugs 60 are not the same size, that is, they do not have the same overall surface area. This feature will be discussed in greater detail, hereinafter.

The flow control valve 10 of the present invention includes a rigid locking member 70 which is operable to be releasably affixed to the distal, or second end 55 of the post 53 in the manner which will be described in greater detail, below. The rigid locking member 70 has a main body 71, with a first end 72, and an opposite, second end 73. Still further, the main body 71 includes an enlarged central region 74. A first aperture 75 is formed in the first end 72. Still further, a second smaller aperture 76 is formed in the second end 73. Yet further a third aperture 77 is formed substantially centrally of the central region 74 of the main body 71.

The rigid locking member 70 further has a top surface 80 and an opposite bottom surface 81. The main body 71 is circumscribed by a downwardly extending peripheral edge 82 which defines a bottom cavity 83. As best understood by a study of FIGS. 3 and 5, the third aperture 77 includes radially extending, oppositely located, lug passageways 84, which facilitate the passage or movement of the respective lugs 60 therethrough and which are made integral with the distal second end 55 of the post 53. As will be recognized by a study of FIG. 8, the lug passageways 84 have individual cross-sectional dimensions which are just slightly larger than the respective lugs 60. Moreover, the size of the respective lug passageways 84 individually correspond to the different cross-sectional dimensions of the respective lugs 60. As earlier stated, the individual lugs 60 are of different cross-sectional dimensions. In view of these size differences, the distal end 55 can only pass through the third aperture 77 in one given orientation thereby preventing the rigid locking member 70 from being inadvertently attached to the post 53 in a wrong orientation. This feature allows the invention to be easily disassembled then reassembled in a correct manner as might be occasioned by the cleaning of the invention 10 after it has been used. As will be best seen by reference to FIG. 3, and FIG. 4, a pair of movement limiting races 85 are mounted on, and positioned radially outwardly relative to, the third aperture 77. The respective movement limiting races are generally arcuately shaped. The pair of movement-limiting races 85 each have a first end 86, and a second or distal end 87 (FIG. 3). Additionally, a stop member 88 extends substantially radially inwardly relative to the second or distal end 87. When assembled, the second or distal end 55 of the post 53 is appropriately oriented and extends through the third aperture 77, and then, by rotation of the post 53, or the rigid locking member 70, the locking lugs 60 cooperate, and move along the respective pair of movement limiting races 85 from the first end 86 to the second end 87. When the respective lugs 60 reach the stop member 88, further rotation is impeded, and the post 53 is releasably secured to the rigid locking member 70. To release the locking member 70 from the distal or second end 55, the reverse of the aforementioned procedure is undertaken.

Figure 8:
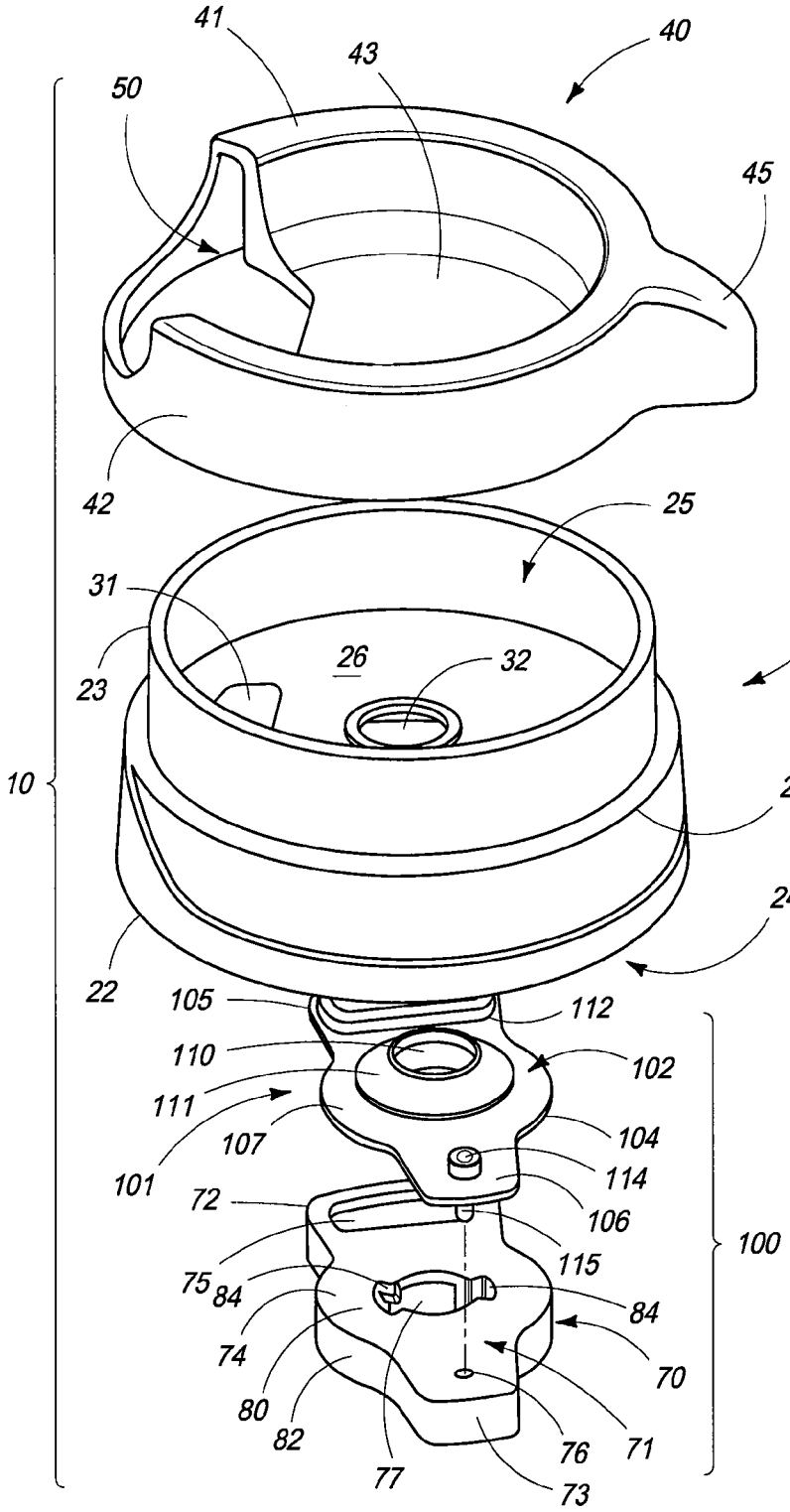
FIG. 8 is a second exploded side elevation view of the present invention.

The present invention 10 includes, as a general matter, a second portion of the flow control valve and which is generally indicated by the numeral 100 (FIG. 8). The second portion of the flow control valve 100 is formed by the operative combination of the rigid locking member 70, moving in unison with a resilient sealing and biasing member that is generally indicated by the numeral 101 and which matingly cooperates with the rigid locking members 70. In operation, and when assembled, the second portion 100 of the flow control valve 10 is releasably mounted on, and co-rotates with the post 53. When assembled, the first portion of the flow control valve 20 is positioned, therebetween, the rotatable control member 40, and the second portion 100. In operation, as will be described, below, the second portion 100 substantially occludes the first aperture 31, of the first portion 20, when the fluid dispensing aperture 50 is not substantially coaxially aligned with the first aperture 31. The resilient sealing and biasing member 101 has a main body 102 which is shaped similarly relative to the top surface 80 of the underlying rigid locking number 70. The resilient sealing and biasing member 101 has a top surface 102, and an opposite bottom surface 104 which is juxtaposed relative to the top surface 80. Still further, the resilient sealing and biasing member 101 has a first end 105, and an opposite second end 106. As will be seen in the drawings, the main body 102 has a central region 107 which is located between the first and second ends 105 and 106, respectively.

Figure 5:
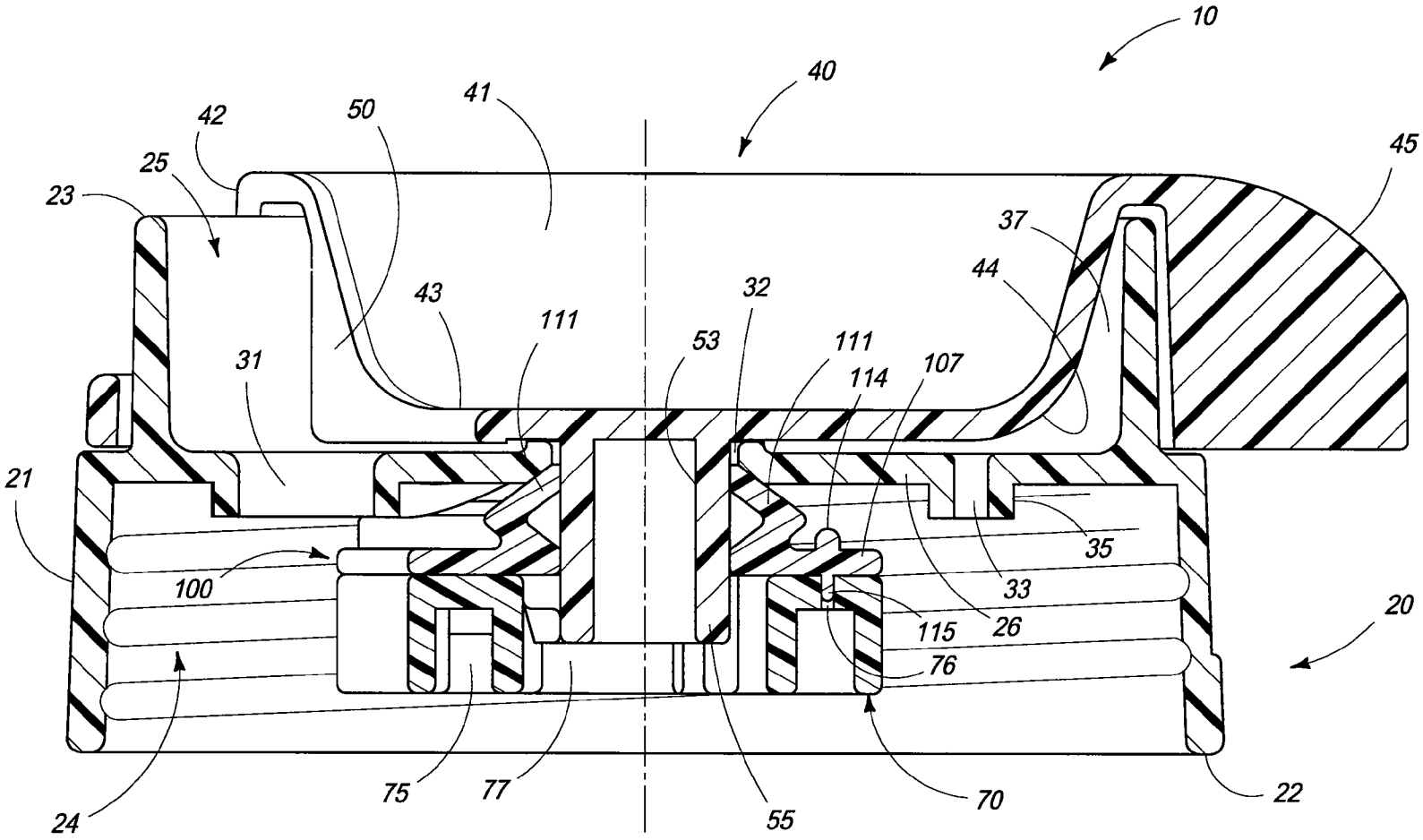
FIG. 5 is a transverse vertical sectional view of the flow control valve of the present invention and which is taken along line 5-5 of FIG. 1.

As best illustrated by reference to FIGS. 4 and 5, the resilient sealing and biasing member 101 has formed, in the central region 107, thereof, a central aperture 110 which is dimensioned so as to allow the passage of the post 53, and in particular, the distal end 55, therethrough. Positioned on the top surface 102 of the resilient sealing and biasing member 101 is a frusto-conically and annular shaped biasing portion 111. The annular shaped biasing portion 111 is coaxial aligned with the central aperture 110, and extends upwardly relative to the resilient sealing and biasing member 101, and is further operable to engage the separation surface 26 in the region of the second aperture 32 so as to simultaneously provide a biasing force which urges together the first portion 20 of the flow control valve 10, and the rotatable control member 40, and further inhibits the source of fluid 17, which is contained in the vessel 11, from passing through the second aperture 32 which is formed in the separation surface 26. This annular shaped biasing portion 111 has a tendency to occlude any gap or space which is defined between the post 53, and the aperture 32. This is best seen by reference to FIG. 6. As will be seen in FIGS. 4 and 5, the main body 102 further includes first and second substantially coaxial aligned, upwardly and downwardly extending, resilient, fluid blocking members 112 and 113, respectively, and which are individually operable to substantially occlude the first aperture 31 which is defined by the first portion 20 of the fluid control valve 10, and the first aperture 75 which is formed in the main body 71 of the rigid locking member 70. In this regard, the second resilient fluid blocking member 113 completely occludes, and extends through the first aperture 75 of the rigid locking member thereby orienting the main body 102 of the resilient sealing and biasing member 101, in substantial alignment relative to the main body 71 of the rigid locking member 70. Further, as will be seen in the drawings, the resilient sealing and biasing member 101, and more specifically the second end 106 thereof includes a third upwardly extending resilient sealing member 114 which, in operation, is operable to occlude the third aperture 33. Further the second end 106 further includes a fourth resilient engagement member 115 which extends downwardly from the second end 106 and which is operable to be received in the second aperture 76 which is formed in the rigid locking member 70. As will be appreciated, therefore, the second resilient fluid blocking member 113, and the resilient engagement member 115, once received in the apertures 75 and 76, respectively orient the main body 102 in a fashion such that the resilient sealing and biasing member 101 substantial co-rotates or moves in unison together with the rigid locking member 70, and in the fashion which will be described in greater detail, hereinafter.

OPERATION

The operation of the described embodiment of the present invention 10 is believed to be readily apparent, and is briefly summarized at this point. A first aspect of the present invention, relates to a flow control valve 10 for dispensing a source of fluid 17 which is enclosed within a vessel 11. A first portion 20 of the flow control valve 10 is provided, and which releasably, matingly, cooperates with the vessel 11, and which further defines a first aperture 31 through which the source of fluid 17 might pass therethrough; and a second aperture 32. A rotatable control member 40 is provided, and which rotatably cooperates with the first portion 20, and which has a main body 41 which defines a fluid dispensing aperture 50, which, when substantially coaxially aligned with the first aperture 31 allows the source of fluid 17 to pass, or be poured out of the vessel 11. As earlier noted, when the fluid dispensing aperture 50 is not substantially coaxially aligned with the first aperture 31, the rotatable control member 40 causes the occlusion of the first aperture 31. Further, the rotatable control member 40 further has a post 53, which is dimensioned so as to be received within the second aperture 32 which was defined by the first portion 20. The rotatable control member 40 rotates about the post 53 and relative to the first portion 20. The invention 10 includes a second portion 100 which is releasably mounted on, and which co-rotates with the post 53, and wherein the first portion 20 of the flow control valve 10 is positioned, therebetween, the rotatable control member 40, and the second portion 100, and wherein the second portion 100 substantially occludes the first aperture 31 which is defined by the first portion 20, when the fluid dispensing aperture 50 is not substantially coaxially aligned with the first aperture 31.

Another aspect of the present invention relates to a flow control valve 10 for dispensing a source of fluid 17, and which includes a vessel 11 which encloses the source of fluid 17 to be dispensed, and which has a neck 15. The invention 10 includes a first portion 20 of a flow control valve having a main body 21, with a first end 22, which releasably mates with the neck 15 of the vessel 11, and an opposite second end 23, and wherein the main body further defines a lower, first cavity 24, and an upper, or second cavity 25. The first and second cavities are separated, one from the other, by a separation surface 26, and wherein a first, second, and third apertures 31, 32 and 33, respectively, are formed in the separation surface 26. The first aperture 31 permits the source of fluid 17 to pass therethrough, and the third aperture 33 permits ambient air to pass into the vessel 11 when the source of fluid 17 is poured from the vessel 11 through the first aperture 31. The present invention also includes a rotatable control member 40 having a main body 41 with a top and a bottom surface 43 and 44, respectively, and further having a peripheral edge 42, and wherein a fluid dispensing aperture 50 is defined by the main body 41, and wherein a post 53 extends downwardly from the bottom surface 44, and is sized so as to be received in, and extend through, the second aperture 32 which is defined by the first portion 20 of the flow control valve 11. The main body 41 of the rotatable control member 40 further defines a bottom cavity 51 which matingly receives, at least in part, a portion of the first end 22 of the first portion 20 of the flow control valve. The bottom surface 44 of the rotatable control member 40 is received, at least in part, within the upper or second cavity 25 of the first portion 20 of the flow control valve. The rotatable control member 40, as earlier noted, coaxially rotates relative to the first portion 20 of the flow control valve, and wherein the source of fluid 17 can flow from the vessel 11 when the fluid dispensing aperture 50 is substantially coaxially aligned with the first aperture 31, and which is defined by the first portion 20 of the flow control valve. A rigid locking member 70, is provided, and which releasably mates, and substantially co-rotates with the post 53, and wherein the first portion of the flow control valve is located therebetween the rigid locking member 70, and the main body 41 of the rotatable control member 40. The rigid locking member 70 defines a first, second, and third passageway 75, 76 and 77, respectively, and which extends therethrough. A resilient sealing and biasing member 101 is matingly coupled with, and juxtaposed relative to, the rigid locking member 70, and is further located therebetween the first portion 20 of the flow control valve, and the rigid locking member 70. The resilient sealing and biasing member 101 co-rotates with the rigid locking member, 70, and further exerts a biasing force against the rigid locking member 70 and the separation surface 26, of the first portion 20 of the flow control valve, so as to resiliently urge the first portion 20 of the flow control valve, and the rotatable control member 70 together. The resilient sealing and biasing member 101 further defines first, and second substantially coaxial aligned, and upwardly and downwardly extending resilient fluid blocking members 112 and 114, respectively, which are individually operable to substantially occlude the first and third apertures 31 and 33, and which are defined by the first portion 20 of the fluid control valve when the rotatable control member 20 is located in a given orientation relative to the first portion 20 of the flow control valve.

Figure 6:
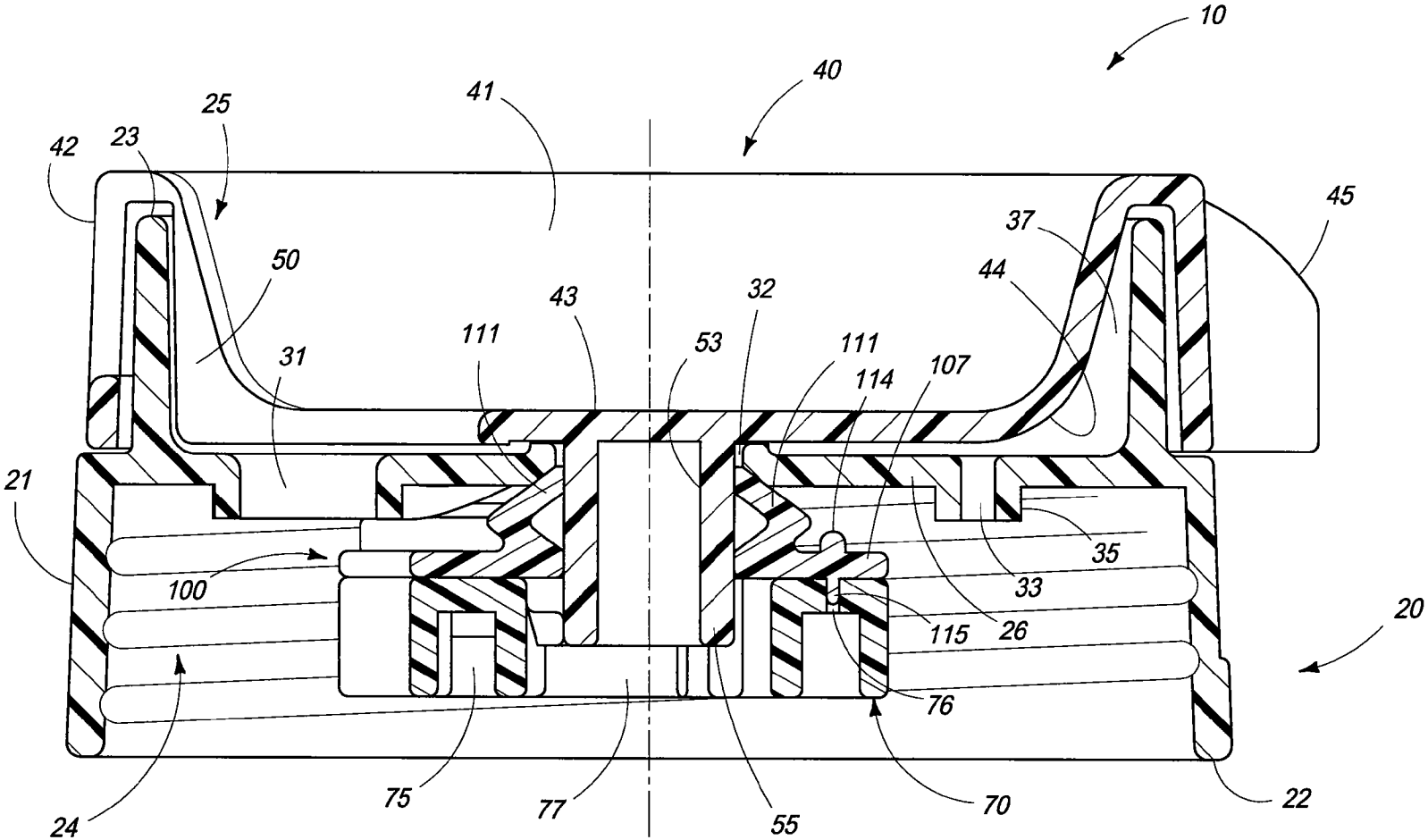
FIG. 6 is a transverse, vertical, sectional view of the present invention and which is taken from a position along line 6-6 of FIG. 1.

As seen in the drawings, the resilient sealing and biasing member 101 further has a central aperture 110 formed therein. The central aperture 110 is substantially coaxially aligned relative to the third aperture 77 which is formed in the central region 74 of the rigid locking member 70. The resilient sealing and biasing member 101 has an annular, frusto-conical shaped biasing portion 111 which is substantially coaxially aligned with the central aperture 110, and which extends upwardly relative to the resilient sealing and biasing member 101 (FIG. 8). This biasing portion 111 further is operable to engage the separation surface 26 in the region of the second aperture 32 which is formed in the separation surface 26 so as to simultaneously provide a biasing force which urges together the first portion 20 of the flow control valve 10 and the rotatable control member 40, and to further inhibit the source of fluid 17, which is contained in the vessel 11, from passing through the second aperture 32 which is formed in the separation surface 26 (FIG. 6). As will be seen in the drawings, the post 53 of the rotatable control member 40 has a distal end 55 which includes at least one radially extending locking lug 60 which forcibly engages the rigid locking member 70. The third aperture 77 of the rigid locking member 70 is shaped so as to allow the distal end 55 of the post 53, including the radially extending locking lug 60, to pass therethrough. The rotation of the rigid locking member 70 relative to the post 53 causes the locking lug 60 to forcibly engage the rigid locking member 70 in FIG. 3.

Figure 2:
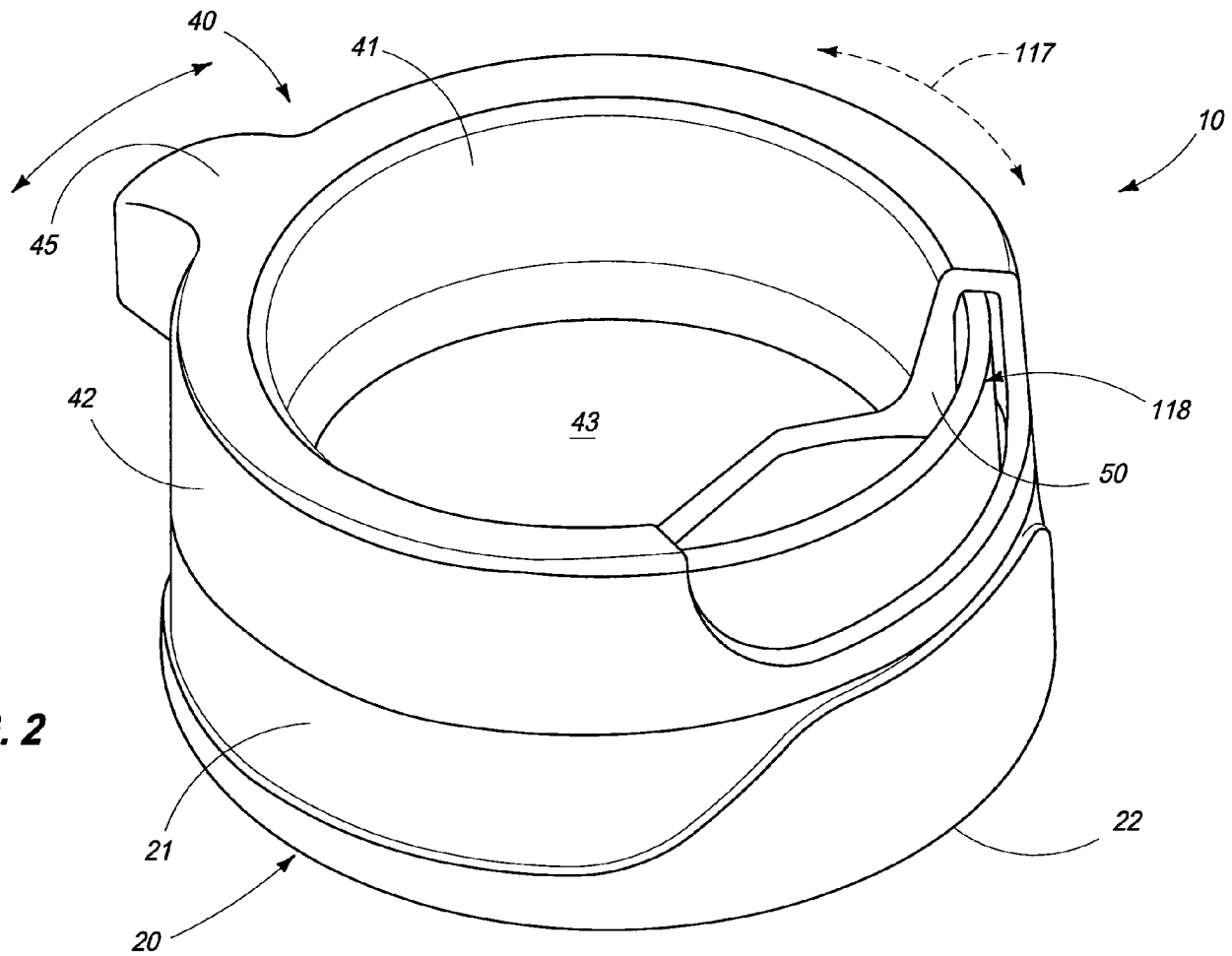
FIG. 2 is a second, top plan view of the flow control valve of the present invention, and which is shown in a second operational position.

The present invention 10 includes an operator engagement member 45 which is made integral with a peripheral edge 42 of the rotatable control member 40, and which receives force supplied by an operator (not shown) which is effective to rotate the rotatable control member 40 along a path of travel 116 between a first and second operational position, 117 and 118 respectively. In the first operational position 117, the fluid dispensing aperture 50 of the rotatable control member 40 is substantially coaxially aligned with the first aperture 31, which is formed in the first portion 20 of the flow control valve 10. Still further, the rigid locking member 70 is simultaneously rotated to a position where the first and second ends 72 and 73 do not occlude the first and third apertures 31 and 33, respectively which are defined by the first portion 20, of the fluid control valve (FIGS. 1 and 3). In the first position 117 the source of fluid 17 in the vessel 11 may pass from the vessel through the coaxial aligned first aperture 31 of the first portion 20 and the fluid dispensing aperture 50 of the rotatable control member 40 (FIGS. 1 and 3). In the second position 118, (FIG. 2), the fluid dispensing aperture of the rotatable control member 40 and the first aperture 31 of the first portion 20 of the flow control valve are not coaxially aligned, and the rigid locking member 70 is rotated to position where the first and second ends thereof 72 and 73, respectively, carry the resilient sealing and biasing member 101 to an orientation where the resilient sealing and biasing member 101 simultaneously occludes the first and third apertures 31 and 33 defined by the first portion 20 of the flow control valve and thereby impedes the release of the source of fluids 17 from the vessel 11 (FIG. 3 Phantom Lines).

As will be appreciated from a study of the drawings, the reciprocal path of travel 116 of the rotatable control member 40 is defined by the engagement of the rigid locking member 70 with the movement limiting member 34 which is mounted on the separation surface 26, and with the elevated region 35. In the first position 117, the first end 72 of the rigid locking member 70 rests thereagainst the movement limiting member 34; and in the second position 118 the second end 73 of the rotatable control member 70 is located in covering relation relative to the elevated region 35, and the engagement member 114 mounted on the second end 106 of the resilient sealing and biasing member 101 is received in and substantially occludes the third aperture 33 of the first portion of the flow control valve.

Therefore, it will be seen that the present invention 10 provides a convenient means whereby fluid 17 may be conveniently dispensed from a vessel 11 in a manner not possible heretofore. Still further, the present device conveniently seals the vessel 11, and prevents the escape of fluid 12 from same in the event that it is inadvertently overturned. Additionally, the present invention 10 avoids the shortcomings attendant to the prior art devices by being easily disassembled, and cleaned, and then readily reassembled in a convenient manner.

In compliance with the statute, the invention has been described in language more or less specific as to structural and methodical features. It is to be understood, however, that the invention is not limited to the specific features shown and described SINCE the means herein disclosed comprise preferred forms of putting the invention into effect. The invention is, therefore, claimed in any of its forms or modifications within the proper scope of the appended claims appropriately interpreted in accordance with the DOCTRINE OF EQUIVALENTS.

We claim:

1. A flow control valve for dispensing a source of fluid, comprising:

a source of fluid to be dispensed, and which is enclosed within a vessel having a neck;

a first portion of a flow control valve having a main body with a first end which releasably mates with the neck of the vessel, and an opposite second end, and wherein the main body further defines a lower, first cavity, and an upper, or second cavity, and wherein the first and second cavities are separated, one from the other by a separation surface, and wherein a first, second and third aperture are formed in the separation surface, and wherein the separation surface further has an elevated region which extends into the lower, first cavity of the first portion of the flow control valve, and wherein the elevated region has a ramp portion which extends downwardly from the elevated region and to the separation surface, and wherein the third aperture formed in the separation surface extends through the elevated region, and wherein the first aperture permits the source of fluid to pass therethrough, and wherein the third aperture permits ambient air to pass into the vessel when the source of fluid is poured from the vessel through the first aperture, and wherein the first portion of the flow control valve further includes a movement limiting member which is mounted on the separation surface, and which extends downwardly into the lower, or first cavity thereof;

a rotatable control member having a main body with a top and bottom surface, and further having a peripheral edge, and wherein a fluid dispensing aperture is defined by the main body, and wherein a post extends downwardly from the bottom surface, and is sized so as to be received in, and extend through, the second aperture which is defined by the first portion of the flow control valve, and wherein the main body of the rotatable control member further defines a bottom cavity which matingly receives, at least in part, a portion of the first end of the first portion of the flow control valve, and wherein the bottom surface of the rotatable control member is received, at least in part, within the upper or second cavity of the first portion of the flow control valve, and wherein the rotatable control member coaxially rotates relative to the first portion of the flow control valve, and wherein the source of fluid can flow from the vessel when the fluid dispensing aperture is substantially coaxially aligned with the first aperture which is defined by the first portion of the flow control valve;

a rigid locking member which releasably mates and substantially co-rotates with the post, and wherein the first portion of the flow control valve is located therebetween the rigid locking member, and the main body of the rotatable control member, and wherein the rigid locking member defines first, second, and third apertures extending therethrough, and wherein the rigid locking member engages the movement locking member upon rotation of the rotatable control member so as limit the coaxial rotation of the rotatable control member relative to the first portion of the flow control valve; and a resilient sealing and biasing member matingly coupled with, and juxtaposed relative to the rigid locking member, and located therebetween the first portion of the flow control valve, and the rigid locking member, and wherein the resilient sealing and biasing member co-rotates with the rigid locking member, and further exerts a biasing force against the rigid locking member and the separation surface of the first portion of the flow control valve so as resiliently urge the first portion of the flow control valve, and the rotatable control member together, and wherein the resilient sealing and biasing member further defines first, and second, substantially coaxially aligned, upwardly and downwardly extending, resilient fluid blocking members which are individually operable to substantially occlude the first and third apertures which are defined by the first portion of the fluid control valve when the rotatable control member is located in a given orientation relative to the first portion of the flow control valve.

2. A flow control valve as claimed in claim 1, and wherein the rigid locking member has a main body with a first and second end, and a central region located between the opposite first and second ends, and wherein the first aperture of the rigid locking member is formed in the first end; the second aperture of the rigid locking member is formed in the central region; and the third aperture of the rigid locking member is formed in the second end thereof.

3. A flow control valve as claimed in claim 2, and wherein the resilient sealing and biasing member further includes an engagement member which extends downwardly relative to the second end thereof, and which is received in, and substantially occludes, the third aperture of the rigid locking member, and wherein the second, downwardly extending, blocking member of the resilient sealing and biasing member is received in, and substantially occludes the first aperture of the rigid locking member.

4. A flow control valve as claimed in claim 3, and wherein the resilient sealing and biasing member further has a central aperture formed therein, and wherein the central aperture is substantially coaxially aligned relative to the third aperture formed in the central region of the rigid locking member, and wherein the resilient sealing and biasing member has an annular shaped biasing portion which is coaxially aligned with the central aperture, and which extends upwardly relative to the resilient sealing and biasing member, and which further is operable to engage the separation surface in the region of the second aperture formed in the separation surface so as to simultaneously provide a biasing force which urges together the first portion of the flow control valve and the rotatable control member, and which further inhibits the source of fluid contained in the vessel from passing through the second aperture formed in the separation surface.

5. A flow control valve as claimed in claim 4, and wherein the post of the rotatable control member has a distal end which includes at least one radially extending locking lug which forcibly engages the rigid locking member, and wherein the third aperture of the rigid locking member is shaped so as to allow the distal end of the post, including the radially extending locking lug, to pass therethrough, and wherein rotation of the rigid locking member relative to the post causes the locking lug to forcibly engage the rigid locking member.

6. A flow control valve as claimed in claim 5, and wherein the rigid locking member further includes at least one movement limiting race which is mounted in spaced relation relative to the second aperture thereof, and wherein the movement limiting race is arcuately shaped, and has a proximal, and a distal end, and wherein a stop member is made integral with the distal end of the movement limiting race , and wherein the radially extending locking lug cooperatively engages and moves along the movement limiting race when the rigid locking member is rotated relative to the post, and the locking lug engages the stop member to prohibit further rotation of the rotatable locking member relative to the post.

7. A flow control valve as claimed in claim 6, and wherein the peripheral edge of the rotatable control member is elevated so as to define an upper cavity, and wherein an operator engagement member is made integral with the peripheral edge of the rotatable control member and which receives force applied by the operator so as to rotate the rotatable control member along a path of travel between a first and second position, and wherein, in the first position, the fluid dispensing aperture of the rotatable control member is substantially coaxially aligned with the first aperture formed in the first portion of the flow control valve, and the rigid locking member is simultaneously rotated to a position where the first and second ends thereof do not occlude the first and the third apertures which are defined by the first portion of the fluid control valve, and wherein, in the first position, the source of fluid in the vessel may pass from the vessel through the coaxially aligned first aperture of the first portion, and the fluid dispensing aperture of the rotatable control member, and wherein, in the second position, the fluid dispensing aperture of the rotatable control member, and the first aperture of the first portion of the flow control valve are not coaxially aligned, and the rigid locking member is rotated to a position where the first and second ends thereof carry the resilient sealing and biasing member to an orientation where the resilient sealing and biasing member simultaneously occludes the first and third apertures which are defined by the first portion of the flow control valve, and thereby impedes the release of the source of fluid from the vessel.

8. A flow control valve as claimed in claim 7, and wherein the post has a pair of locking lugs extending radially outwardly relative to the distal end thereof, and wherein the rotatable locking member includes a pair of movement limiting races which are operable to matingly cooperate with the pair of locking lugs.

9. A flow control valve as claimed in claim 8, and wherein the path of travel of the rotatable control member is defined by the engagement of the rotatable locking member with the movement limiting member which is mounted on the separation surface, and the elevated region, and wherein in the first position the first end of rigid locking member rests thereagainst the movement limiting member, and wherein in the second position, the second end of the rotatable control member is located in covering relation relative to the elevated region.

* * * * *